United States Patent [19]

Husome

[11] Patent Number: 4,915,517

[45] Date of Patent: Apr. 10, 1990

[54] PRINT HEAD

[76] Inventor: Robert G. Husome, 3243 Betsy Ross Way, Boise, Id. 83706

[21] Appl. No.: 363,701

[22] Filed: Jun. 9, 1989

[51] Int. Cl.[4] ..... B41J 3/10

[52] U.S. Cl. ..... 400/124; 101/93.05

[58] Field of Search ..... 400/124, 124 IW, 124 TC, 400/719

[56] References Cited

U.S. PATENT DOCUMENTS

| | | | |
|---|---|---|---|
| 4,044,668 | 8/1977 | Barrus et al. | 101/93.04 |
| 4,571,101 | 2/1986 | Sakaida et al. | 400/124 |
| 4,699,051 | 10/1987 | Jezbera | 400/719 |

FOREIGN PATENT DOCUMENTS

| | | | |
|---|---|---|---|
| 56-89963 | 7/1981 | Japan | 400/124 TC |
| 62-18276 | 1/1987 | Japan | 400/124 TC |

*Primary Examiner*—Edgar S. Burr
*Assistant Examiner*—Ren Yan
*Attorney, Agent, or Firm*—Paul F. Horton

[57] ABSTRACT

A print head for the print wire impact type dot matrix printer, including means for producing a gas flow into a sealed print head housing and through tubular linear bearings of an end guide to prevent migration of ribbon ink into the bearings and the housing. Sufficient gas pressure is provided to create gas bearings for each print wire to reduce friction between the reciprocally moving print wire and the end guide for superior performance and to lessen wear on both the print wire and the guide. Gas flow to create gas bearings in internal guides is also provided.

8 Claims, 1 Drawing Sheet

PRINT HEAD

BACKGROUND OF THE INVENTION

1. Field of the Invention

This invention relates, in general, to dot matrix print heads utilizing print wires and, more particularly, to the linear bearings supporting the print wires.

2. Description of the Prior Art

The principal cause of failure of print heads of the dot matrix type utilizing print wires reciprocal within tubular linear bearings is the migration of ink from the ribbon into the bearings. The ink, which is adsorbed on the wires as they impact the ribbon, moves along the length of the print wire into the tubular bearing of the end guide and on into the housing and the linear bearings of internal guides where it congeals. The congealed ink eventually produces sufficient friction within the bearings to cause faulty impact between the print wire and the ribbon; slow return resulting in snagging of the ribbon; and bending or breaking of the print wires. Heretofore, there was no known way to prevent this problem.

Another problem with existing print wire bearings is the friction between the print wire and the linear bearing resulting in wear on both the print wire and the bearing resulting in poor performance of the print head.

While several inventions, as typified by U.S. Pat. No. 4,044,668, issued to G. B. Barrus et al, and U.S. Pat. No. 4,571,101, issued to A. Sakaida et al, utilize air flow within printer housings for cooling purposes, no inventions are known which provide gas flow through linear bearings to prevent ink migration along print wires nor are any inventions known which provide gas bearings for the support of print wires.

SUMMARY OF THE INVENTION

The present invention overcomes the problem of ink migration along print wires and into bearings and overcomes the problem of poor performance and print wire and bearing wear due to friction by providing a pressurized gas source operable to force gas through print wire support bearings and by providing print wires which are supported by gas bearings.

Additional objects and advantages will become apparent and a more thorough and comprehensive understanding ma be had from the following description taken in conjunction with the accompanying drawings forming a part of this specification.

DETAILED DESCRIPTION OF THE INVENTION

Figure 1:
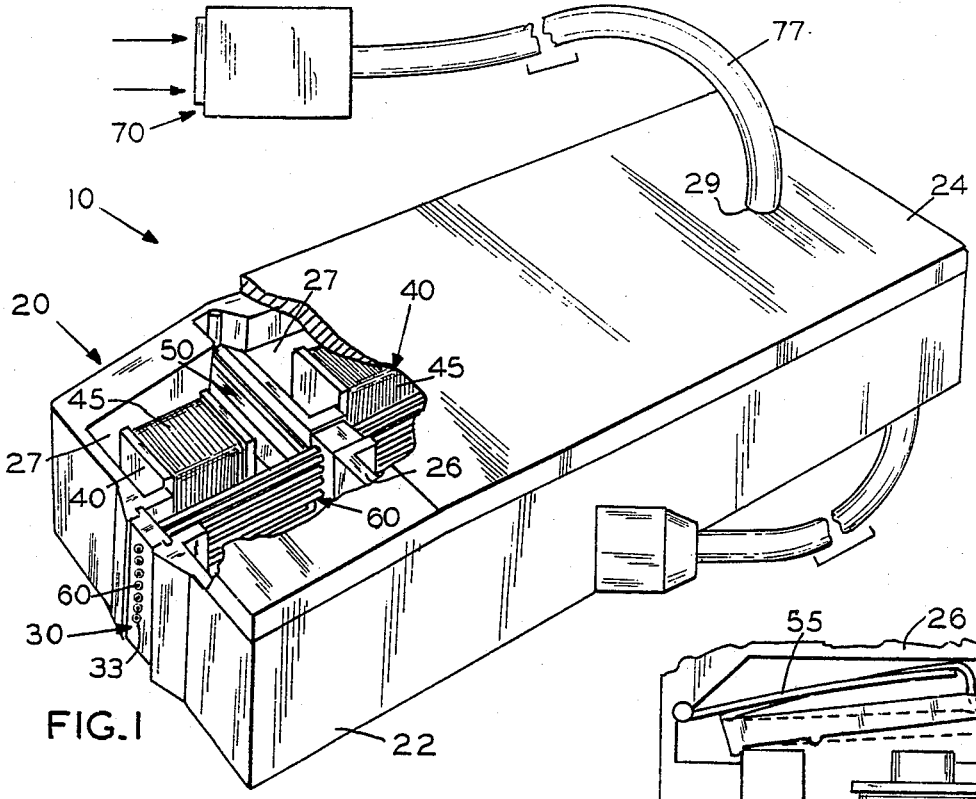
FIG. 1 is a perspective view, in partial section, of a preferred embodiment of the print head of the present invention.

Referring now to the drawings, and, more particularly, to FIG. 1, an embodiment to be preferred of a print head 10, made according to the present invention, is disclosed. Print head 10 includes, generally, a housing 20, a print wire end guide 30; a plurality of coils 40 with armatures 50; a plurality of print wires 60, each print wire affixed to a respective armature; and a pressurized gas source, designated generally by the numeral 70.

Figure 2:
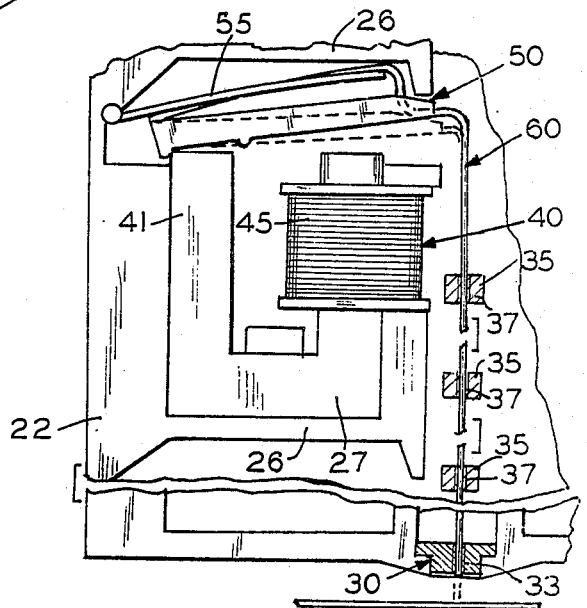
FIG. 2 is a plan sketch showing one print unit.

Housing 20 may be constructed of any suitable material and in any suitable shape and preferably includes a container 22 having a cover 24 for entrance into the container. In the embodiment shown in FIG. 1, the housing is provided with a select number of partitions 26, defining a series of compartments 27. Each compartment, as shown to advantage in FIG. 2, holds a coil 40 surrounding a magnetic core 41 and a pivotal armature 50 held in a retracted position by a leaf spring 55. Connected to each armature is a print wire 60 which may be supported within the housing by one or more internal print wire guides 35, each provided with a linear bearing 37, in the form of a tubular aperture, circular in cross-section. Each print wire is supported adjacent its impact end by print wire end guide 30, also provided with a linear bearing 33, also in the form of a tubular aperture, circular in cross section, through which the print wire is reciprocated. Upon energizing of the coil, the armature is drawn into contact with core 41, overcoming the bias of spring 55, to cause the print wire to which the armature is attached to move through the bearings supporting it and to impact ribbon 90 for printing. De-energization of the coil causes the armature and print wire to return to its original position. The housing may include any desired number of coils, each with its respective armature and print wire and the internal print wire guides and end guide are each provided with a sufficient number of linear bearings to accommodate the print wires passing therethrough. The linear bearings are constructed of material such as jewel, ceramic, or high density plastic to form a good bearing surface.

Figure 3:
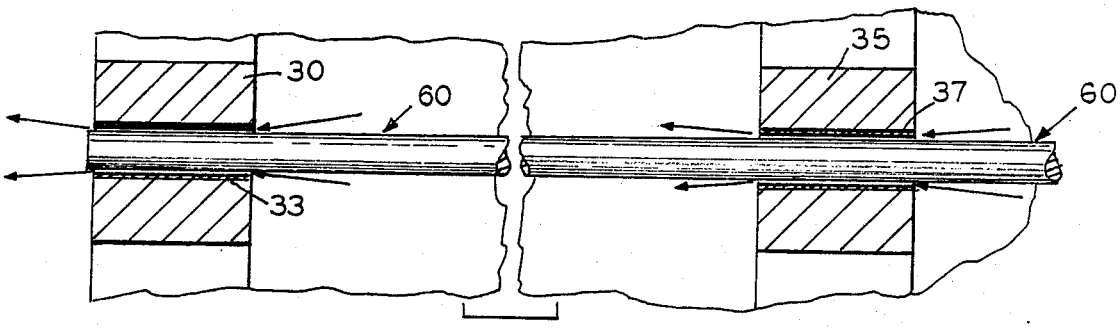
FIG. 3 is a sectional view of one print wire shown in conjunction with tubular linear support bearings.

Critical to the present invention is a pressurized gas source 70 for forcing gas into housing 20 and a housing which is sufficiently gas tight so as to force the pressurized gas within the housing out through the tubular linear bearings 33 of end guide 30, as may be seen in FIG. 3, only one bearing being shown. The gas, shown by arrows, enters through gas port 29 and exits through the annular space defined between the print wire and the inner surface of its respective linear bearing to prevent ink, which adheres to the print wire 60 from the print wire's impact with the ribbon, from being carried back into the bearing where it might congeal. It is also to be appreciated that gas flow through bearings 33 creates within the tubular bearing a gas bearing to support the print wire relative to the surface of the tubular bearing to reduce or eliminate contact between the print wire and the internal walls of the bearing. This reduction in frictional contact serves to reduce wear on both the print wire and the end guide housing the bearing and also provides superior performance of the print head.

Figure 4:
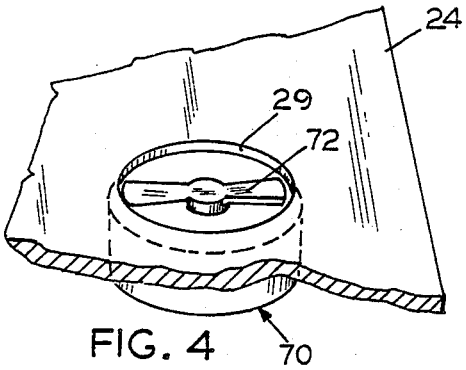
FIG. 4 is a second embodiment of the pressurized gas source of the present invention, shown mounted on the print head housing.

To also provide gas flow through bearings 37 of internal print wire guides 35, the intake gas port 29 in housing 20 is located adjacent the back of the housing, ie., on the opposing side of the housing from end guide 30 and gas seals, not shown, between consecutive internal guides provide sufficient drop in gas pressure to promote flow through the bearings. Pressurized gas source 70 may be located at a suitable location on the printer and connected to housing 20 by means of a flexible gas hose 77, as shown in FIG. 1; may be located on the printer so as to inject a charge of gas into the housing upon each or selected reciprocations of the print head relative to the framework of the printer; or, as shown in FIG. 4, may be located on and made a part of the print head 10 itself. The source, as shown, is an air pump including a motor and fan unit 72 for pumping air into the housing, but may be pressurized gas in bottles or cannisters; chemically produced gas; and the like. The word "flexible", used in reference to the gas hose herein and in the claims, includes resilient hose as well as rigid, jointed, hose.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. Print head apparatus comprising:

a hollow, substantially gas tight, housing, said housing including a gas intake port;

an end guide mounted on said housing, said end guide provided with a plurality of tubular linear bearings;

a plurality of coils mounted within said housing;

a plurality of armatures mounted within said housing, each of said armatures in electromagnetic engagement with a respective coil;

a plurality of print wires contained within said housing, each of said print wires connected to a respective armature and each of said print wires reciprocally movable in a respective linear bearing of said end guide for impacting an ink ribbon upon selective actuation of said coils; and means providing a gas bearing in each of said tubular linear bearings including a pressurized gas source for forcing gas through said gas port into said housing to provide gas flow through each of said linear bearings to provide a gas hearing and to prevent ink flow from said ribbon into said bearings.

2. The apparatus as described in claim 1 wherein said pressurized gas source is located externally of said housing and is connected to the gas intake port of said housing by a flexible gas conduit.

3. The apparatus as described in claim 1 wherein said pressurized gas source is located on said housing.

4. The apparatus as described in claim 1 wherein said housing is provided with one or more internal guides, each of said internal guides provided with one or more tubular linear bearings and wherein said pressurized gas source provides gas flow through each of said bearings.

5. Print head apparatus comprising:

a hollow, substantially gas tight, housing, said housing including a gas intake port;

an end guide mounted on said housing, said end guide provided with a plurality of tubular linear apertures;

a plurality of coils mounted within said housing;

a plurality of armatures mounted within said housing, each of said armatures in electromagnetic engagement with a respective coil;

a plurality of print wires contained within said housing, each of said print wires connected to a respective armature and each of said print wires reciprocally movable in a respective linear aperture of said end guide for impacting an ink ribbon upon selective actuation of said coils; and means providing a gas bearing in each of said tubular linear apertures including a pressurized gas source for forcing gas through said gas port into said housing under sufficient pressure to provide a gas bearing within each of said linear apertures for supporting each of said print wires to reduce friction between said print wires and said end guide.

6. The apparatus as described in claim 5 wherein said pressurized gas source is located externally of said housing and is connected to the gas intake port of said housing by a flexible gas conduit.

7. The apparatus as described in claim 5 wherein said pressurized gas source is located on said housing.

8. The apparatus as described in claim 5 wherein said housing is provided with one or more internal guides, each of said internal guides provided with one or more tubular apertures and wherein said pressurized gas source provides gas flow through each of said apertures.

* * * * *